US007907031B2

(12) United States Patent
Kim et al.

(10) Patent No.: US 7,907,031 B2
(45) Date of Patent: Mar. 15, 2011

(54) TRANSIT STRUCTURE BETWEEN A WAVEGUIDE AND A DIELECTRIC WAVEGUIDE HAVING A MATCHING CAVITY

(75) Inventors: Bong-Su Kim, Daejon (KR); Kwang-Seon Kim, Daejon (KR); Woo-Jin Byun, Daejon (KR); Ki-Chan Eun, Daejon (KR); Myung-Sun Song, Daejon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 111 days.

(21) Appl. No.: 12/096,597

(22) PCT Filed: Aug. 31, 2006

(86) PCT No.: PCT/KR2006/003460

§ 371 (c)(1),
(2), (4) Date: Jun. 6, 2008

(87) PCT Pub. No.: WO2007/066876

PCT Pub. Date: Jun. 14, 2007

(65) Prior Publication Data

US 2008/0309427 A1 Dec. 18, 2008

(30) Foreign Application Priority Data

Dec. 8, 2005 (KR) ..... 10-2005-0119591
Apr. 19, 2006 (KR) ..... 10-2006-0035298

(51) Int. Cl.
*H01P 1/16* (2006.01)

(52) U.S. Cl. ..... 333/21 R; 333/33; 333/248

(58) Field of Classification Search ..... 333/21 R, 333/248, 33

See application file for complete search history.

(56) References Cited

U.S. PATENT DOCUMENTS 3,928,825 A 12/1975 Kaffenberger et al.
3,995,238 A * 11/1976 Knox et al. ..... 333/21 R
5,982,256 A * 11/1999 Uchimura et al. ..... 333/239
6,489,855 B1 * 12/2002 Kitamori et al. ..... 333/21 R

FOREIGN PATENT DOCUMENTS

EP 1396902 3/2004

(Continued)

OTHER PUBLICATIONS

Yong Huang et al., "A Broad-Band LTCC Integrated Transition of Laminated Waveguide to Air-Filled Waveguide for Millimeter-Wave Applications" IEEE Transactions on Microwave Theory and Techniques, vol. 51, No. 5, May 2003, pp. 1613-1617.

*Primary Examiner* — Benny Lee
(74) *Attorney, Agent, or Firm* — Rabin & Berdo, P.C.

(57) ABSTRACT

A transit structure of a standard waveguide and a dielectric waveguide is related to connecting the dielectric dielectric waveguide to the standard waveguide. The transit structure includes: a cavity to match the dielectric waveguide and the standard waveguide, wherein the dielectric waveguide and the standard waveguide are orthogonal to each other to connect. The transit structure drastically reduces a design time by simply implementing a transit structure by using only a dielectric waveguide, a cavity and a standard waveguide on a dielectric substrate and remarkably reduces a size thereof in comparison with a conventional transit structure since all designs are finished in the size of a metal waveguide.

8 Claims, 3 Drawing Sheets

FOREIGN PATENT DOCUMENTS

| | | |
|---|---|---|
| JP | 2004-135095 | 4/2004 |
| JP | 2004-201163 | 7/2004 |
| JP | 2004-357042 | 12/2004 |
| JP | 2005-012699 | 1/2005 |
| JP | 2005-020415 | 1/2005 |
| KR | 2005-0059764 | 6/2005 |
| KR | 100576552 | 4/2006 |

* cited by examiner

TRANSIT STRUCTURE BETWEEN A WAVEGUIDE AND A DIELECTRIC WAVEGUIDE HAVING A MATCHING CAVITY

TECHNICAL FIELD

The present invention relates to a transit structure of two waveguides, one of which is a dielectric waveguide; more particularly, to a transit structure to implement a matching (impedance matching) with a simple structure when a dielectric waveguide is connected to a waveguide.

BACKGROUND ART

Wireless communication in a knowledge information era is expected to be developed from a second generation wireless communication based on sound and text, and a third generation mobile communication of image information transmission (IMT2000), to a fourth generation system having a transmission speed larger than 100 Mbps. The fourth generation system having such a broad bandwidth requires use of a new frequency in place of a conventional frequency, as the conventional frequency bandwidth has already become saturated, and it is very important to use a millimeter wave bandwidth as the frequency to realize such a broad bandwidth and high-speed communication.

However, the communication system of a millimeter wave bandwidth is expensive and bulky as a result of being constructed with a plurality of individual devices, which are the shortcomings in commercializing this bandwidth. In order to overcome these shortcomings and to use millimeter wave RF components, many studies have been developed for the miniaturization of the devices, devices having a low cost and a low loss, and a related packaging technology.

Particularly, in case that a System in a Package (SiP) technology employs a low temperature Co-fired ceramics (LTCC), various types of such devices have been proposed, such as a point to multi-points communication transceiver with 26 GHz bandwidth, and a short range wireless communication system with 60 GHz and 70 GHz bandwidths.

In such a millimeter wave system, various types of transit structures are used for connecting the transmitters or the receivers to the antennas.

Generally, a conventional transit structure is a micro strip line, or a transit structure of a strip line and a waveguide, by using a single layer substrate technology. A rear side cavity shape is generally required through fabrication of a mechanical structure.

Recently, a transit structure using a stack process has appeared; this is a structure using a dielectric cavity and an aperture with a lowest surface as a dielectric waveguide and another waveguide. In such conventional technology, there are several shortcomings in realizing a structure having an optimum performance, due to a complex matching structure and dielectric resonator, and many parameters the aperture may have.

SUMMARY OF THE INVENTION

Technical Problem

The present invention has been proposed in order to overcome the above-described problems in the related art. A dielectric waveguide and another waveguide are placed in an orthogonal direction, and a matching is implemented by providing a simple structure with a cavity for a matching between the two dielectric waveguides. It is, therefore, an object of the present invention to provide a transit structure to reduce a size thereof and to shorten a design time thereof.

It is another object of the present invention to provide a transit structure of two waveguides including a dielectric waveguide, capable of easily compensating a frequency and matching error generated during practical manufacturing, by varying an impedance characteristic of the dielectric waveguide by allowing a change in the degree of insertion of a tuning rod into the dielectric waveguide.

In order to achieve the above-described objects, the present invention is a transit structure generally including a dielectric waveguide, a cavity and another waveguide, wherein the cavity is placed between the dielectric waveguide and the another waveguide.

Technical Solution

In accordance with an aspect of the present invention, there is provided a transit structure of two waveguides including a dielectric waveguide, characterized in that: the dielectric waveguide is positioned in a direction orthogonal to the other waveguide to connect the two waveguides; and the transit structure includes a cavity to match the dielectric waveguide with the other waveguide.

In accordance with another aspect of the present invention, there is provided a transit structure for connecting a waveguide to a dielectric waveguide, the transit structure including: a cavity to match the dielectric waveguide and the other waveguide, wherein the dielectric waveguide and the other waveguide are orthogonal to each other.

It is preferable that the dielectric waveguide includes: a first ground surface existing at a top surface of the dielectric waveguide; a second ground surface existing at a bottom surface of the dielectric waveguide where a pattern at a portion thereof connected to the cavity is removed; a dielectric substrate is placed between the first ground surface and the second ground surface to form the dielectric waveguide; and a plurality of conductive vias arranged in at least one row connected to the first ground surface and the second ground surface to form a wall of the dielectric waveguide.

It is preferable that if the plurality of conductive vias is arranged in at least two rows, the conductive vias of a front row and the conductive vias of a rear row are placed to connect with each other.

It is preferable that the dielectric waveguide is made of many folded dielectric substrates and a top via and a bottom via are connected by a pattern.

It is preferable that the cavity is formed by removing a portion of the dielectric substrate placed between a top of a second ground surface where a pattern of a cavity portion is removed and a bottom of a third ground surface where a pattern of the cavity portion is removed, and a cavity wall is formed by a plurality of conductive vias arranged in at least one row to connect the second ground surface to the third ground surface.

It is preferable that if the conductive vias are arranged in at least two rows, the conductive vias of a front row and the conductive vias of a rear row are placed to connect with each other.

It also is preferable that the dielectric waveguide is made of many folded dielectric substrates, and a top via and a bottom via are connected by a pattern.

It is preferable that the dielectric waveguide allows a tuning rod to be inserted, and is capable of controlling a degree of insertion of the tuning rod.

It is preferable that the insertion of the tuning rod is performed by inserting the tuning rod into a hole to face a cavity connection unit on the dielectric waveguide.

It also is preferable that the transit structure further includes: a dielectric substrate formed on a dielectric waveguide; and a most upper ground surface, wherein the plurality of holes for insertion of the tuning rod is formed on the upper most ground surface and the dielectric substrate.

Advantageous Effects

The present invention can drastically reduce a design time by simply implementing a transit structure by using only a dielectric waveguide, a cavity and another waveguide on a dielectric substrate, and remarkably reduce a size thereof in comparison with a conventional transit structure, since all designs are finished in a metal waveguide.

BRIEF DESCRIPTION OF THE DRAWINGS

The above and other objects and features of the present invention will become apparent from the following description of the preferred embodiments given in conjunction with the accompanying drawings, in which.

BEST MODE FOR CARRYING OUT THE INVENTION

Hereinafter, preferred embodiments of the present invention are described in detail with respect to the accompanying drawings in such a manner that it may easily be carried out by a person having ordinary skilled in the art to which the invention pertains. Similar components are labeled with the same reference numbers in these drawings.

Figure 1:
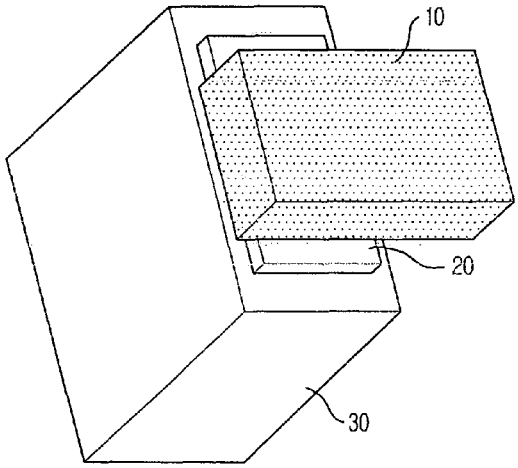
FIG. 1 is a concept diagram showing a transit structure of two waveguides, wherein one is a dielectric waveguide, in accordance with one embodiment of the present invention.

FIG. 1 is a concept diagram showing a transit structure of two waveguides including a dielectric waveguide in accordance with one embodiment of the present invention.

Figure 2:
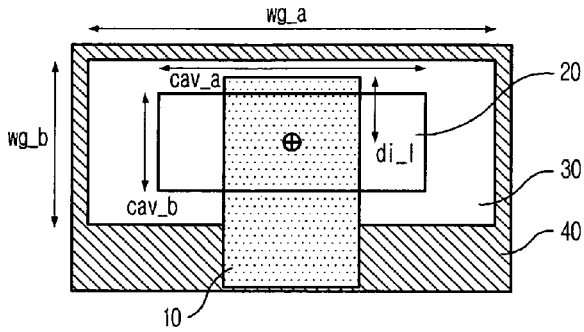
FIG. 2 is a plan view of the transit structure of FIG. 1.
Figure 3:
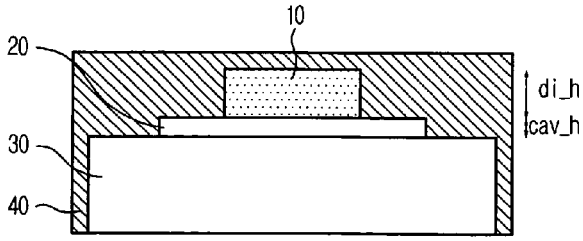
FIG. 3 is a cross-sectional view of FIG. 1.

An overall transit structure includes 3 types of elements i.e., a dielectric waveguide 10, a cavity 20, and another waveguide 30, as shown in FIG. 1, and a housing 40 (as illustrated in FIGS. 2 and 3). Sizes of the dielectric waveguide 10 and the waveguide 30 are generally determined by a frequency of the overall system and a structure of a transceiver or the like, and, a width and a height of the cavity 20 positioned between the dielectric waveguide 10 and the waveguide 30 become important factors to determine a performance of the transit structure.

FIG. 2 and FIG. 3 are respectively a plan view and a cross-sectional view of the structure shown in FIG. 1.

The sizes wg_a and wg_b of the waveguide 30 shown in FIG. 2 are parameters that are previously determined by a frequency of the system. For example, in case of a WR-22 rectangular waveguide, wg_a×wg_b=5.8 mm×2.9 mm.

In order to design the dielectric waveguide based on the other waveguide with an inside thereof being filled with air, overall sizes of the designed waveguide must be constantly reduced by a ratio of $1/\sqrt{\in_r}$ in all three dimensions according to the change of the dielectric constant as shown in the following mathematical equation (1).

$$\lambda_g=2\pi/\beta=2\pi\sqrt{k^2-k_c^2} \quad \text{Eq. (1)}$$

Wherein, in the equation (1), $\lambda_g$ is a wavelength of the waveguide, $\beta$ is a propagation constant, $\kappa$ is a frequency of the material, $\kappa_c$ is a blocking wave number, and $k=\omega\sqrt{\mu\in}$, $k_c=\sqrt{(m\pi/a)^2+(n\pi/b)^2}$ (where $\omega$ denotes an angular frequency, $\mu$ is a permeability, $\in$ is a permittivity, m and n are two integers representing orders, a is a length of a longitudinal axis and b is a length of a vertical axis).

Since, at a high frequency on the order of a millimeter wave, a relation of $k>>k_c$ exists, it is noted that $\lambda_g$ is inversely proportional to $\sqrt{\in_r}$ as a simplification, where $\in_r$ is the relative permittivity of the material thereof. Since a waveguide filter utilizes a TE10 mode, z-axis, i.e., the height, does not affect the performance except for resulting in a slight incremental loss.

That is, in case when a dielectric constant of 7.1 is used, the size of a WR-22 waveguide is 5.8 mm×2.9 mm, whereas the size of the dielectric waveguide becomes $5.8/\sqrt{7.1}=2.18$ mm×$2.9/\sqrt{7.1}=1.09$ mm.

In FIG. 2, a length di_1 from a center of the cavity 20 to an end of the dielectric waveguide 10 is a very important parameter to determine the transit frequency, and the sizes cav_a and cav_b of the cavity 20 play roles in matching the dielectric waveguide 10 with the waveguide 30—the overall performance is largely determined by those parameters.

In FIG. 3, a height di_h of the dielectric waveguide 10 and a height cav_h of the cavity 20 are shown. Herein, the height of the dielectric waveguide 10 does not greatly affect the performance as described above when the dielectric waveguide 10 is operated as a waveguide, but it becomes a major parameter to control the frequency and to control the matching when the transit structure is designed. The height cav_h of the cavity 20 is a major parameter to perform the matching, together with the widths cav_a and cav_b of the cavity 20, as shown in FIG. 2.

Therefore, the transit structure in accordance with the present invention determines the performance thereof according to the height di_h and the width di_1 of the dielectric waveguide 10 and the widths cav_a and cav_b of the cavity. Since the height of the dielectric waveguide 10 and the height of the cavity 20 depend on a previously determined height of the multi-layered substrate (and also, it is possible that the height of the multi-layered substrate is controlled by folding various sheets, but a continuous change is difficult), the performance of the waveguide transit structure in accordance with the present invention is determined according to the length of the dielectric waveguide 10 and the cavity 20.

Figure 4:
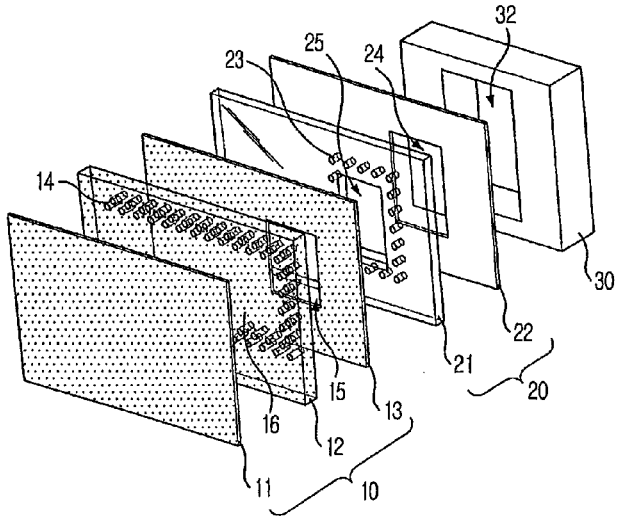
FIG. 4 is a three-dimensional exploded perspective view of the transit structure of FIG. 1 in accordance with one embodiment of the present invention.

FIG. 4 is a three-dimensional exploded perspective view in accordance with one embodiment of the present invention.

FIG. 4 shows a structure that a dielectric substrate 12 forming the dielectric waveguide 16 has a first ground surface 11 and a second ground surface 13, and the first ground surface 11 and the second ground surface 13 are connected through a plurality of conductive vias 14. The plurality of conductive vias 14 can be at least one row to form a wall of the dielectric waveguide 16, since it prevents a signal from leaking from the dielectric waveguide. If two rows of the conductive vias are placed to connect with each other, as shown in the drawings, the performance of the dielectric waveguide 16 is further improved. In the second ground surface 13, a pattern formed on a surface adjacent to the cavity 25 is removed (as referred to by reference numeral 15 in FIG. 4).

The cavity 25 is formed by removing a portion of the dielectric substrate 21. The second ground surface 13 formed on a top of the dielectric substrate 21, and a third ground surface 22 formed on a bottom of the dielectric substrate 21 are connected through the conductive vias 23. The conductive vias 23 are positioned with maximal access to the sidewall of the cavity 25 to form a complete cavity 25. At least one row of the conductive vias 23 can be used in a similar manner to that for the dielectric waveguide. Similar to the second ground surface 13, a pattern at a portion contacting the cavity 25 is removed (as referred to by reference numeral 24 in FIG. 4). Cavity 32 is a path in which a wave is guided.

The waveguide 30 is placed below the cavity 25. Herein, the waveguide 30 is generally made of metal, but it can give a effect similar to that of the metal by coating metal on a surface of a general dielectric material. Therefore, the present invention is not limited to the metal.

Figure 5:
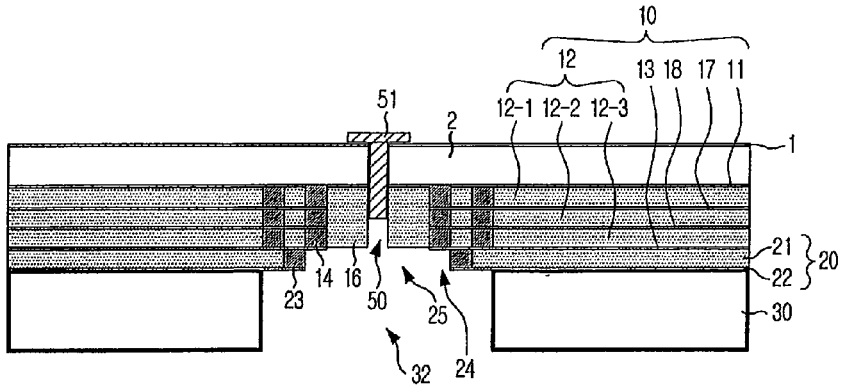
FIG. 5 is a cross-sectional view of another embodiment of the transit structure.

FIG. 5 is a cross-sectional view showing application of the transit structure of the present invention to a practical circuit board. It is a drawing of a cross-sectional view of the transit structure shown in FIG. 4 , but also shows a tuning rod and dielectric substrate 12 of multiple layers. As shown in the drawing, the first ground surface 11 and the second ground surface 13 for the circuit substrate 2 and the dielectric waveguide 16 placed in the module are formed inside of the multi-layered substrate. A plurality of layers 12-1, 12-2 and 12-3 can be formed between the first ground surface and the second ground surface 13. In this case, the plurality of conductive vias 14 are formed in each layer to connect the first ground surface 11 and the second ground surface 13, and a plurality of patterns 17 and 18 are formed to connect the plurality of conductive vias 14. A hole 50 is formed to insert the tuning rod 51 from the most upper ground surface 1 to the dielectric waveguide 16. The second ground surface 13 and the third ground surface 22 are formed on a bottom portion of the dielectric waveguide 16 to construct the cavity 25, and a plurality of layers can be formed between the second ground surface 13 and the third ground surface 22 similar to the multiple layers for the dielectric waveguide 16. A plurality of conductive vias 23 is formed along a plurality of wall surfaces of the cavity 25 to connect the plurality of layers.

Finally, a waveguide 30 is placed on the third ground surface 22, and is formed to be connected to a device having an external waveguide interface such as an external filter and an antenna or the like.

While the present invention has been described with respect to certain preferred embodiments, it will be apparent to those skilled in the art that various changes and modifications may be made without departing from the scope of the invention as defined in the following claims.

What is claimed is:

1. A waveguide transit structure, comprising:

a first waveguide;

a second waveguide being a dielectric waveguide, the dielectric waveguide being orthogonal to the first waveguide, and having a hole disposed thereon; and a cavity disposed between the first waveguide and the dielectric waveguide for matching the dielectric waveguide and the first waveguide, the cavity being in communication with the hole.

2. The waveguide transit structure as recited in claim 1, wherein the dielectric waveguide includes:

a first ground surface;

a second ground surface having a portion thereof removed;

a dielectric substrate placed between the first ground surface and the second ground surface; and a plurality of conductive vias arranged in at least one row connecting the first ground surface and the second ground surface, thereby defining a wall of the dielectric waveguide.

3. The waveguide transit structure as recited in claim 2, wherein the plurality of conductive vias are arranged in at least two rows; and the plurality of conductive vias of the at least two rows are comprised of a front row thereof, and a rear row thereof, and the conductive vias of the front and rear rows are placed to connect with each other.

4. The waveguide transit structure as recited in claim 3, wherein the dielectric substrate is comprised of a plurality of laminated dielectric substrates.

5. The waveguide transit structure as recited in claim 1, further comprising:

a second ground surface having a portion thereof removed;

a third ground surface having a portion thereof removed;

a dielectric substrate disposed between the second and third ground surfaces and having a portion thereof removed, thereby providing the cavity; and a plurality of conductive vias arranged in at least one row connecting the second and third ground surfaces, thereby providing a wall of the cavity.

6. The waveguide transit structure as recited in claim 5, wherein the plurality of conductive vias are arranged in at least two rows; and the plurality of conductive vias of the at least two rows is comprised of a front row thereof, and a rear row thereof, and the conductive vias of the front and rear rows are placed to connect with each other.

7. The waveguide transit structure as recited in claim 1, wherein the dielectric waveguide includes:

a dielectric substrate; and a uppermost ground surface, wherein the hole is disposed on the uppermost ground surface and the dielectric substrate.

8. The waveguide transit structure as recited in claim 1, further including a tuning rod insertable into the hole, a degree of the insertion of the tuning rod being controllable.

* * * * *